US007753778B2

(12) United States Patent
Kato

(10) Patent No.: US 7,753,778 B2
(45) Date of Patent: Jul. 13, 2010

(54) SLOT MACHINE AND PLAYING METHOD THEREOF

(75) Inventor: Yoichi Kato, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 580 days.

(21) Appl. No.: 11/778,435

(22) Filed: Jul. 16, 2007

(65) Prior Publication Data

US 2008/0045312 A1 Feb. 21, 2008

(30) Foreign Application Priority Data

Aug. 1, 2006 (JP) ..... 2006-209720

(51) Int. Cl.
*A63F 13/00* (2006.01)

(52) U.S. Cl. ..... 463/20; 463/16; 463/17; 463/18; 463/19

(58) Field of Classification Search ..... 463/16–20, 463/30

See application file for complete search history.

(56) References Cited

U.S. PATENT DOCUMENTS

| | | | | |
|---|---|---|---|---|
| 6,068,553 | A * | 5/2000 | Parker | 463/27 |
| 6,093,102 | A | 7/2000 | Bennett | |
| 6,095,921 | A * | 8/2000 | Walker et al. | 463/20 |
| 6,579,178 | B1 * | 6/2003 | Walker et al. | 463/20 |
| 6,875,106 | B2 * | 4/2005 | Weiss et al. | 463/20 |
| 6,905,407 | B2 * | 6/2005 | Nordman | 463/20 |
| 6,960,133 | B1 | 11/2005 | Marks et al. | |
| 7,306,520 | B2 * | 12/2007 | Kaminkow et al. | 463/20 |
| 7,311,603 | B2 * | 12/2007 | Walker et al. | 463/20 |
| 7,452,269 | B2 * | 11/2008 | Gauselmann | 463/16 |
| 7,473,173 | B2 * | 1/2009 | Peterson et al. | 463/20 |
| 7,601,061 | B2 * | 10/2009 | Jackson | 463/20 |
| 7,614,949 | B2 * | 11/2009 | Anderson et al. | 463/20 |
| 2003/0181239 | A1 * | 9/2003 | Walker et al. | 463/20 |
| 2005/0119039 | A1 * | 6/2005 | Berman et al. | 463/16 |
| 2006/0073867 | A1 * | 4/2006 | Rothkranz | 463/16 |
| 2006/0135243 | A1 * | 6/2006 | Englman et al. | 463/16 |

OTHER PUBLICATIONS

U.S. Appl. No. 12/403,811, filed Mar. 13, 2009, Kato.
U.S. Appl. No. 12/404,778, filed Mar. 16, 2009, Kato.
U.S. Appl. No. 11/779,446, filed Jul. 18, 2007, Kato.
U.S. Appl. No. 11/779,483, filed Jul. 18, 2007, Kato.
U.S. Appl. No. 11/779,661, filed Jul. 18, 2007, Kato.
U.S. Appl. No. 12/474,935, filed May 29, 2009, Kato, et al.

* cited by examiner

*Primary Examiner*—James S McClellan
*Assistant Examiner*—Jay Trent Liddle
(74) *Attorney, Agent, or Firm*—Oblon, Spivak, McClelland, Maier & Neustadt, L.L.P.

(57) ABSTRACT

A slot machine of the present invention includes: a display having a screen capable of displaying a symbol arrangement image in which a plurality of symbols are arranged and a plurality of valid area images each having a shape capable of including one or more symbols; and a controller in communication with the display for determining the number of valid area images in accordance with the number of BETs, displaying the symbol arrangement image and the valid area image so as to superpose said valid area images on the symbol arrangement image, in such a manner that said valid area images move and then stop, and providing an award in accordance with a symbol included in the valid area image stopped so that an award in accordance with the symbol included in an overlap area where the valid area images overlap with each other is higher than an award provided in a case of the symbol included in the remaining valid area image.

12 Claims, 8 Drawing Sheets

Fig. 4

| Symbol | Number A of coin-outs (※1) | Number B of coin-outs (※2) | Number C of coin-outs (※3) | Required number of symbols |
|---|---|---|---|---|
| SMILE | Jackpot trigger (※4) | | | 1 |
| CROWN | Bonus game trigger (※5) | | | 3 |
| JEWEL | 30 | 60 | 90 | 3 |
| SUN | 10 | 20 | 30 | 3 |
| MOON | 5 | 10 | 15 | 3 |
| STAR | 3 | 6 | 9 | 3 |
| HEART | 2 | 4 | 6 | 3 |
| RIBBON | 1 | 2 | 3 | 3 |

※1,2,3 The number of coin-outs per inserted coin

※1 The number of coin-outs in non overlap area

※2 The number of coin-outs in two-image overlap area

※3 The number of coin-outs in three-image overlap area

※4 Payout based on progressive jackpot

※5 A predetermined number of free games

Fig. 5

| Number of BETs | Number of valid area images |
|---|---|
| 1～10 | 1 |
| 11～30 | 2 |
| 31～50 | 3 |

SLOT MACHINE AND PLAYING METHOD THEREOF

CROSS-REFERENCE TO RELATED APPLICATIONS

This application claims benefit of priority based on Japanese Patent No. 2006-209720 filed on Aug. 1, 2006. The contents of this application are incorporated herein by reference in their entirety.

BACKGROUND OF THE INVENTION

Field of the Invention

The present invention relates to a slot machine and a playing method thereof.

In a conventional slot machine, although a winning line is generally a linear line, a slot machine having various winning lines other than such a linear winning line and a slot machine which does not have a concept of winning lines have appeared.

Examples of the slot machine a using winning line which are not limited to a linear line are described in, for example, U.S. Pat. Nos. 6,093,102 and 6,960,133.

However, a slot machine which conducts a payout when a predetermined number of symbols are stopped in a display displaying a wining line or a symbol matrix is similar to a slot machine using a linear winning line, with respect to a point that a payout is determined according to the result of a rearrangement of symbols. Namely the display modes of those are similar to one another.

An object of the present invention is to provide a slot machine and a playing method thereof, capable of raising expectations of a player and displaying symbols in a highly entertaining manner.

The contents of U.S. Pat. Nos. 6,093,102 and 6,960,133 are incorporated herein by reference in their entirety.

SUMMARY OF THE INVENTION

To achieve the above-mentioned object, the present invention provides a slot machine in which a valid area capable of including one or more symbols moves and then stops within a symbol arrangement area in which a plurality of symbols are arranged, and a payout is conducted according to the symbols included in the stopped valid area.

A first aspect of the present invention provides a slot machine having the following configuration.

Namely, the slot machine comprises a display having a screen capable of displaying a symbol arrangement image in which a plurality of symbols are arranged and a plurality of valid area images each having a shape capable of including one or more of the symbols, and a controller in communication with the display determining the number of the valid area images in accordance with the number of BETs, displaying to the screen the symbol arrangement image and the determined number of the valid area images so as to superpose the valid area images on the symbol arrangement image, in such a manner that the valid area images move and then stop, and providing an award in accordance with a symbol included in each of the stopped valid area images so that an award in accordance with a symbol included in an overlap area where the valid area images overlap with each other is higher than an award provided in a case of the symbol included in the valid area image other than the overlap area.

In the slot machine, the valid area images of the number in accordance with the number of BETs and each having the shape capable of including one or more symbols are displayed on a symbol arrangement image in which a plurality of symbols are arranged, in such a manner that the valid area images move and then stop.

A payout is conducted in accordance with a symbol included in each of the stopped valid area images. A payout in accordance with a symbol included in an overlap area of the plurality of valid area images is higher than that in a case of the symbol included in the valid area image other than the overlap area.

In other words, although, in a conventional slot machine, symbols are rearranged after determination of a winning line, in the present invention, symbols are rearranged and then the valid area image is moved to determine a payout according to a position where the valid area image stops. Therefore, a player follows the valid area image while wondering where the valid area image stops on the symbol arrangement image until the valid area image stops. Thus, it is possible to display the symbols in a highly entertaining manner and to raise expectations of the player.

Since the number of valid area images increases as the number of BETs increases and the possibility that the overlap area occurs becomes higher, a higher payout can be expected with the larger number of BETs. Therefore, the expectations of the player can be raised in accordance with the number of BETs.

Preferably, the slot machine further comprises the following configuration.

Namely, the controller provides the award in a case where a predetermined number or more of symbols of an identical kind are included in any one of the valid area images.

In the slot machine, it is determined whether a payout is conducted or not so that even a beginner can easily understand only by seeing the symbol arrangement image and the valid area image, therefore, expectations of a player can be further raised.

Preferably, the slot machine further comprises the following configuration.

Namely, the controller provides the award according to a symbol included in the valid area image and the predetermined number of game media to be paid out corresponding to the symbol.

In the slot machine, the amount of payout to be conducted is determined so that even a beginner can easily understand only by seeing the symbol arrangement image and the valid area image, therefore, expectations of a player can be further raised.

A second aspect of the present invention provides a slot machine having the following configuration.

Namely, the slot machine comprises a display having a screen capable of displaying a symbol arrangement image in which a plurality of symbols are arranged and a plurality of valid area images each having a shape capable of including one or more of the symbols, and a controller in communication with the display determining the number of the valid area images in accordance with the number of BETs, displaying to the screen the symbol arrangement image and the determined number of the valid area images so as to superpose the valid area images on the symbol arrangement image, in such a manner that the valid area images move and then stop, and providing, in a case where a predetermined number or more of symbols of an identical kind are included in any one of the stopped valid area images, an award in accordance with the symbol included in the stopped valid area image so that an award in accordance with a symbol included in an overlap area where the valid area images overlap with each other is higher than an award provided in a case of the symbol included in the valid area image other than the overlap area.

Preferably, the slot machine further comprises the following configuration.

Namely, the controller provides the award according to a symbol included in the valid area image and a predetermined number of game media to be paid out corresponding to the symbol.

A third aspect of the present invention provides a slot machine having the following configuration.

Namely, the slot machine further comprises a display having a screen capable of displaying a symbol arrangement image in which a plurality of symbols are arranged and a plurality of valid area images each having a shape capable of including one or more of the symbols, and a controller in communication with the display determining the number of the valid area images in accordance with the number of BETs, displaying to the screen the symbol arrangement image and the determined number of the valid area images so as to superpose the valid area images on the symbol arrangement image, in such a manner that the valid area images move and then stop, and providing, in a case where a predetermined number or more of symbols of an identical kind are included in any one of the stopped valid area images, an award in accordance with the symbol included in the stopped valid area image and a predetermined number of gaming media to be paid out corresponding to the symbol so that an award in accordance with a symbol included in an overlap area where the valid area images overlap with each other is higher than an award provided in a case of the symbol included in the valid area image other than the overlap area.

The first aspect of the invention further provides a playing method of a slot machine comprises the following steps.

Namely, the playing method of the slot machine is a playing method of a slot machine performed by a controller connected to a display and comprises the steps of: determining the number of valid area images each having a shape capable of including one or more symbols in accordance with the number of BETs; displaying to a screen of the display a symbol arrangement image in which a plurality of symbols are arranged and the determined number of the valid area images so as to superpose the valid area images on the symbol arrangement image, in such a manner that the valid area images move and then stop; and providing an award in accordance with a symbol included in each of the stopped valid area images so that an award in accordance with a symbol included in an overlap area where the valid area images overlap with each other is higher than an award provided in a case of the symbol included in the valid area image other than the overlap area.

Preferably, the playing method of the slot machine further comprises the following step.

Namely, the playing method of the slot machine comprises the step of providing the award in a case where a predetermined number or more of symbols of an identical kind are included in any one of the stopped valid area images.

Preferably, the playing method of the slot machine further comprises the following step.

Namely, the playing method of the slot machine comprises the step of providing the award according to the symbol included in the valid area image and a predetermined number of game media to be paid out corresponding to the symbol.

The second aspect of the invention further provides a playing method of a slot machine including the following steps.

Namely, the playing method of the slot machine is a playing method of a slot machine performed by a controller connected to a display and comprises the steps of: determining the number of valid area images each having a shape capable of including one or more symbols in accordance with the number of BETs; displaying to a screen of the display a symbol arrangement image in which a plurality of symbols are arranged and the determined number of the valid area images so as to superpose the valid area images on the symbol arrangement image, in such a manner that the valid area images move and then stops; and providing, in a case where a predetermined number or more of symbols of an identical kind are included in any one of the stopped valid area images, an award in accordance with the symbol included in the stopped valid area image so that an award in accordance with a symbol included in an overlap area where the valid area images overlap with each other is higher than an award provided in a case of the symbol included in the valid area image other than the overlap area.

Preferably, the playing method of the slot machine further comprises the following step.

Namely, the playing method comprises the step of providing the award in accordance with the symbol included in the valid area image and a predetermined number of game media to be paid out corresponding to the symbol.

The third aspect of the invention further provides a playing method of a slot machine comprising the following steps.

Namely, the playing method of the slot machine is a playing method of a slot machine performed by a controller connected to a display and comprises the steps of: determining the number of valid area images each having a shape capable of including one or more symbols in accordance with the number of BETs; displaying to a screen of the display a symbol arrangement image in which a plurality of symbols are arranged and the determined number of the valid area images so as to superpose the valid area images on the symbol arrangement image, in such a manner that the valid area images move and then stop; and providing, in a case where a predetermined number or more of symbols of an identical kind are included in any one of the stopped valid area images, an award in accordance with the symbol included in the stopped valid area image and the predetermined number of game media to be paid out corresponding to the symbol so that an award in accordance with a symbol included in an overlap area where the valid area images overlap with each other is higher than an award provided in a case of the symbol is included the valid area image other than the overlap area.

According to the present invention, expectations of a player can be raised and symbols can be displayed in a highly entertaining manner.

BRIEF DESCRIPTION OF THE DRAWINGS

FIG. 4 is a diagram showing the correspondent relationship between each symbol and the number of game media to be paid out.

FIG. 5 is a diagram showing the corresponding relationships between the number of BETs and the number of the valid area images.

DESCRIPTION OF THE EMBODIMENTS

FIGS. 1A, 1B, FIGS. 2A, 2B and FIG. 3A, 3B are diagrams showing a symbol arrangement image and a valid area image of a slot machine 10 according to the present invention. FIG. 4 is a diagram showing the correspondent relationship between each symbol and the number of game media to be paid out. FIG. 5 is a diagram showing the correspondent relationship between the number of BETs and the number of valid area images. Although the slot machine 10 is of a standalone type which is not connected to a network, the present invention can be also applied to a slot machine connected to a network.

Figure 1A:
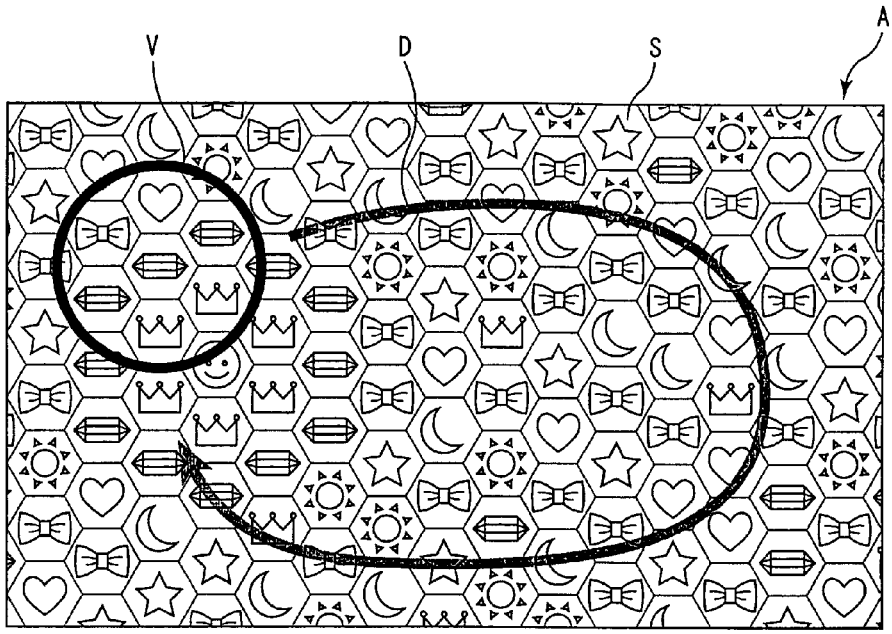
FIGS. 1A and 1B are diagrams showing a symbol arrangement image and a valid area image in a slot machine of the present invention.

When a game starts, as shown in FIG. 1A, a symbol arrangement image A is displayed, and a valid area image V is also displayed so as to be superposed on the symbol arrangement image in such a manner that the valid area image moves in the direction of an arrow D. In the symbol arrangement image A, a plurality of symbols S each having a regular hexagonal shape are disposed.

There are eight kinds of symbols S, which are "SMILE", "CROWN", "JEWEL", "SUN", "MOON", "STAR", "HEART" and "RIBBON". The valid area image V has a circular shape capable of simultaneously including seven symbols at the maximum. The number of valid area images is determined by the number of BETs (see FIG. 5). According to the symbols included in each of the stopped valid area images V, a payout is determined. In a case where two or more valid area images exist, the position at which each of the valid area images stops is determined individually.

As shown in FIG. 4, "SMILE" is assigned as a jackpot trigger. When one or more "SMILEs" are included in the valid area image V, a payout based on a progressive jackpot is conducted. Since the slot machine 10 is of the standalone type, as the payout based on the progressive jackpot, a value obtained by adding an initial payout value to an accumulated value (a value resulted from accumulation of a portion of the number of inserted game media) in the single slot machine 10 alone is employed.

In the present invention, the accumulated value employed for the progressive jackpot is not limited to the above-described value. For example, in a case where the slot machine is connected to a network, an accumulated value in slot machines of the same model in a single casino, an accumulated value in slot machines of the same model in the same area (for example, state or country), or the like may be employed.

In the present embodiment, the payout based on the progressive jackpot is conducted prior to a payout based on other symbols or a bonus game. Therefore, for example, when both of the jackpot trigger and a bonus game trigger are established simultaneously, the payout based the progressive jackpot is conducted but the bonus game is not executed. Even in a case where "SMILE" is included in an overlap area where a plurality of valid area images overlap with each other, the contents of the jackpot generated are the same as those in the other cases.

The "CROWN" is assigned as the bonus game trigger. When three or more "CROWNs" are included in the valid area image V, a predetermined number (for example, 10) of free games are conducted. Such free games are executed as if the same number of coins as that inserted upon establishment of the free games has been inserted, even though no coin has been inserted. For each of "JEWEL", "SUN", "MOON", "STAR", "HEART", and "RIBBON", the number of coin-outs per inserted coin is preliminarily determined. The value of the number B of coin-outs is applied to a symbol included in a two-image overlap area where two valid area images overlap with each other. The value of the number C of coin-outs is applied to a symbol included in a three-image overlap area where three valid area images overlap with each other. The value of the number A of coin-outs is applied to a symbol included in the other areas of the valid area image V. A method of calculating the number of coin-outs will be described in detail later.

Even in a case where "CROWN" is included in the overlap area, the contents of a free game to be conducted are the same as those in the other cases.

Figure 1B:
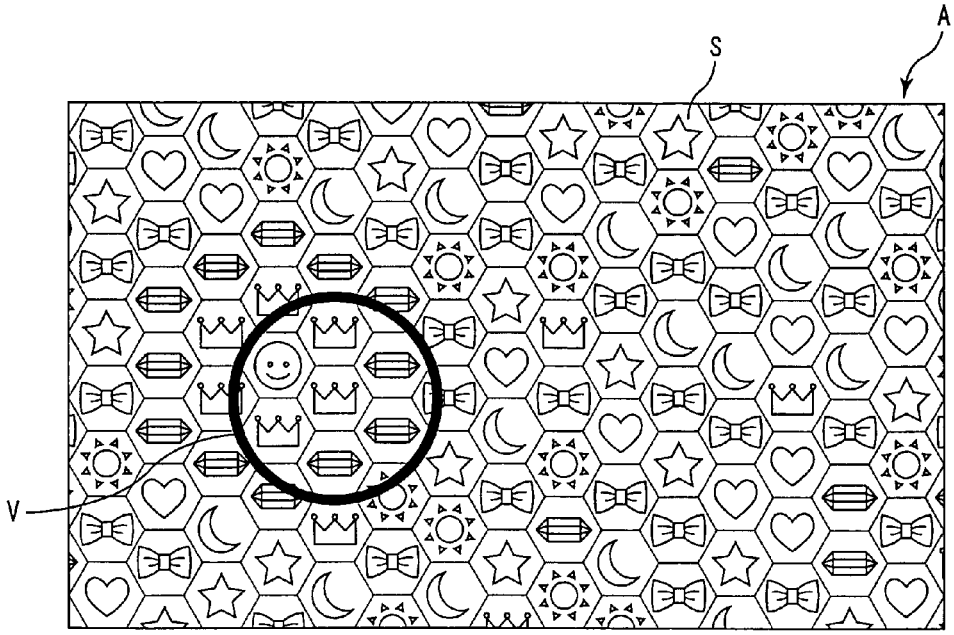

After the image shown in FIG. 1A is displayed, for example, when the valid area image V stops as shown in FIG. 1B, one "SMILE" is included in the valid area image V. Consequently, the jackpot trigger is established, and a payout based on the progressive jackpot is conducted.

Figure 2A:
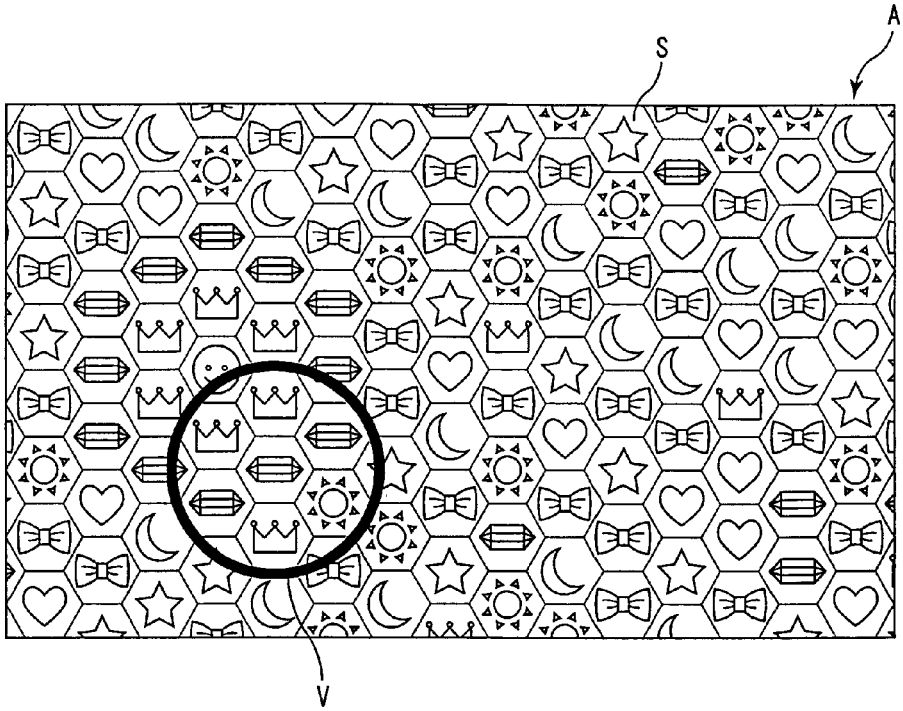
FIGS. 2A and 2B are diagrams showing the symbol arrangement image and the valid area image in the slot machine of the present invention.

After the image shown in FIG. 1A is displayed, for example, when the valid area image V stops as shown in FIG. 2A, three "CROWNs" are included in the valid area image V. Consequently, the bonus game trigger is established, and a predetermined number of free games are conducted. In addition, since three "JEWELs" are included in the valid area image V, a payout is conducted.

Figure 2B:
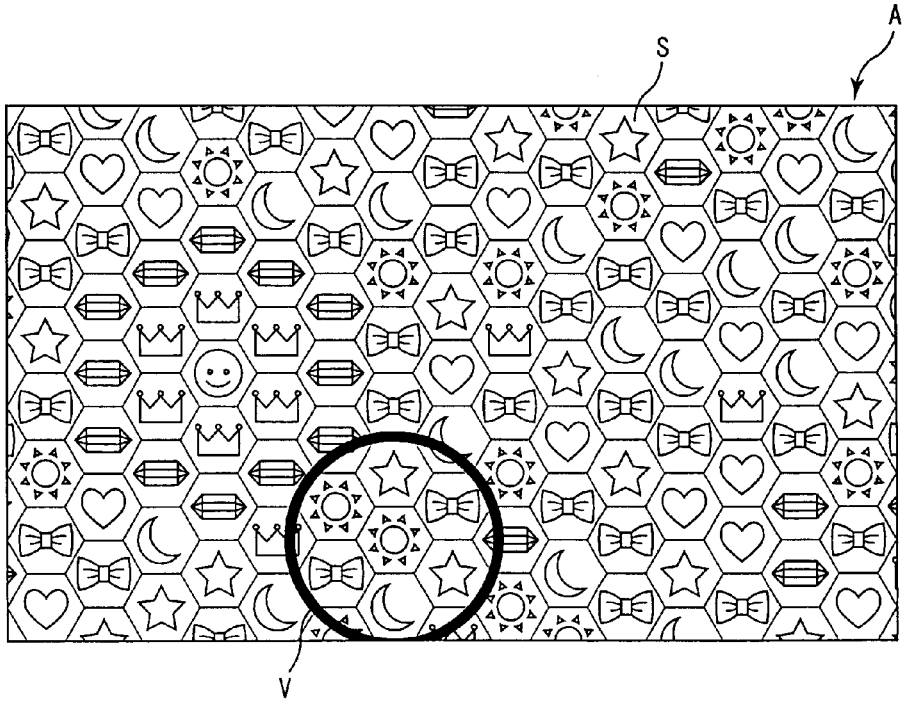

As described above, the number of the valid area images is determined by the number of BETs as shown in FIG. 5. When the number of BETs falls in the range of 1 to 10, as shown in FIGS. 2A and 2B, the number of the valid area images V is one.

Figure 3A:
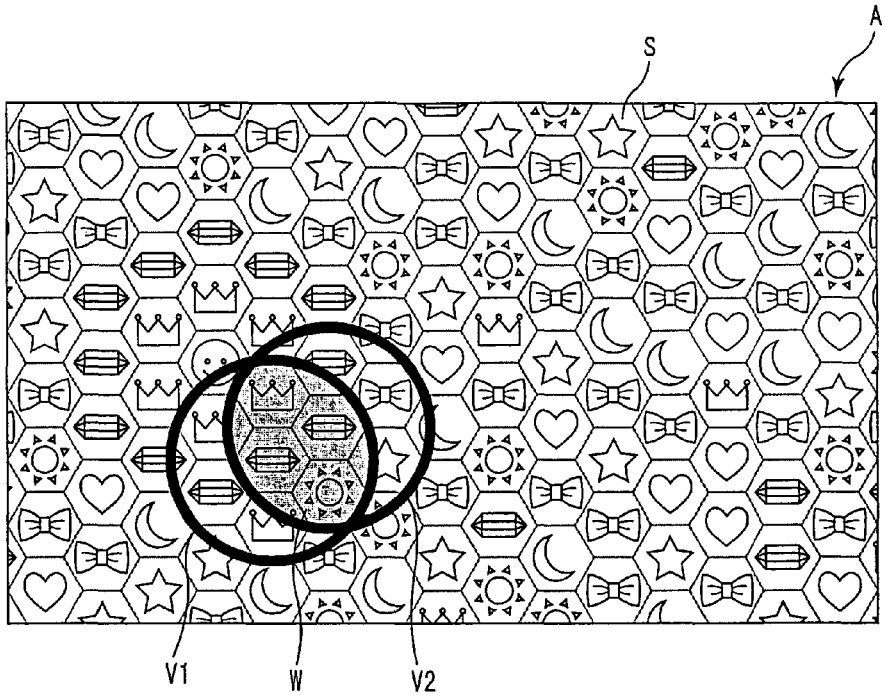
FIGS. 3A and 3B are diagrams showing the symbol arrangement image and the valid area images in the slot machine of the present invention.
Figure 3B:
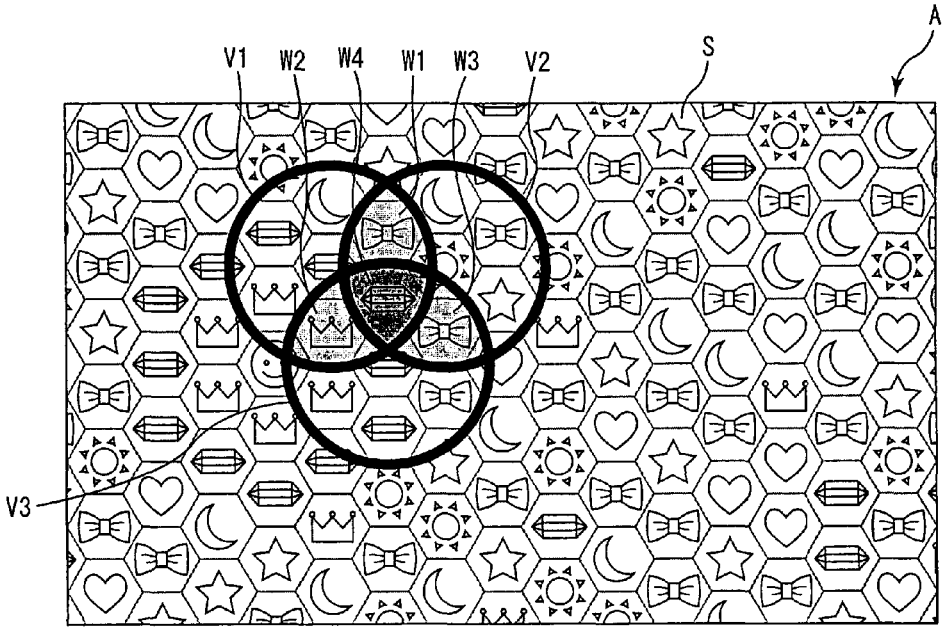

When the number of BETs falls in the range of 11 to 30, as shown in FIG. 3A, the number of the valid area images V becomes two. When the number of BETs falls in the range of 31 to 50, as shown in FIG. 3B, the number of the valid area images V becomes three.

When a plurality of valid area images V are provided, at the time of calculating a payout for a symbol included in an overlap area where the plurality of valid area images V overlap with each other, a value different from that in a case where a symbol is included in the other area of the valid area images V is calculated.

A payout is determined by the following equation (1).

In a case where two or more valid area images V exist, a payout is calculated for each of the valid area images V by the following equation (1), and the total value of payouts for each of the valid area images V becomes the final payout.

Payout=(the number of symbols included in the non overlap area×the number *A* of coin-outs determined for the symbol in the non overlap area+the number of symbols included in the two-image overlap area×the number *B* of coin-outs determined for the symbol included in the two-image overlap area+the number of symbols included in the three-image overlap area×the number *C* of coin-outs determined for the symbol included in the three-image overlap area)×the number of coins inserted (1)

FIGS. 2A and 2B are diagrams showing a symbol arrangement image and a valid area image in a case where the number of BETs is 10 or less.

As shown in FIG. 2A, in a case where three "JEWELs" are included in the stopped valid area image V, when the number of coins inserted in the game is 10, a payout is determined as (3×30)×10=900 (coins). Therefore, in a case where the valid area image V stops as shown in FIG. 2A, when the number of coins inserted in the game is 10, 900 coins are paid out and, after that, the predetermined number of free games are conducted.

After the image shown in FIG. 1A is displayed, for example, when the valid area image V stops as shown in FIG. 2B, two "SUNs", one "MOON", two "STARs", and two "RIBBONs" are included in the valid area image V. In this case, the game ends in a loss and no payout and no bonus game are conducted.

FIG. 3A is a diagram showing a symbol arrangement image and a valid area image in a case where the number of BETs is in the range of 11 to 30. Since the number of BETs falls in the range of 11 to 30, two valid area images V1 and V2 exist. A two-image overlap area W in which the valid area images V1 and V2 overlap with each other is displayed in color different from the other area.

In a case as shown in FIG. 3A, three "JEWELs" are included in the valid area image V1 and two "JEWELs" out of the three "JEWELs" are included in the two-image overlap area W. When the number of coins inserted for the game is 30, a payout for the valid area image V1 is calculated as (1×30+2×60)×30=4500 (coins). Further, three "JEWELs" are included in the valid area image V2 and two "JEWELs" out of the three "JEWELs" are included in the two-image overlap area W. A payout for the valid area image V2 is calculated as (1×30+2×60)×30=4500 (coins). That is, a payout is 4500+4500=9000 (coins).

Therefore, when the valid area images V stop as shown in FIG. 3A and the number of coins inserted for the game is 30, 9000 coins are paid out. Thereafter, since three "crowns" are included in the valid area image V1, the predetermined number of free games are conducted.

FIG. 3B is a diagram showing the symbol arrangement image and the valid area images in a case where the number of BETs is 31 or more. Since the number of BETs is 31 or more, three valid area images V1, V2, and V3 exist. Two-image overlap areas W1, W2, and W3 in each of which two images out of the valid area images V1, V2, and V3 overlap with each other are displayed in color different from the other area. A three-image overlap area W4 in which all of the valid area images V1, V2, and V3 overlap with each other is displayed in color different from the above-described colors.

In a case as shown in FIG. 3B, three "JEWELs" are included in the valid area image V1 and one of them is included in the three-image overlap area W4. When the number of coins inserted for the game is 50, a payout for the valid area image V1 is calculated as (2×30+1×90)×50=7500 (coins). Further, three "ribbons" are included in the valid area image V2, one of them is included in the two-image overlap area W1, and the other one is included in the two-image overlap area W3. A payout for the valid area image V2 is calculated as (1×1+2×2)×50=250 (coins). Further, three "JEWELs" are included in the valid area image V3 and one of them is included in the three-image overlap area W4. Consequently, a payout for the valid area image V3 is (2×30+1×90)×50=7500 (coins). That is, a payout is 7500+250+7500=15250 (coins).

Therefore, when the valid area images V stop as shown in FIG. 3B and the number of coins inserted for the game is 50, 15250 coins are paid out.

In the examples shown in FIGS. 1A, 1B, FIGS. 2A, 2B and FIGS. 3A, 3B, the case where the symbol arrangement image is an image in which symbols each having a regular hexagonal shape are arranged without any gap has been described. In the present invention, however, the symbol arrangement image is not limited to the example. The shapes, kinds, numbers, and the like of the symbols can be properly changed.

In the examples shown in FIGS. 1A, 1B, FIGS. 2A, 2B and FIGS. 3A, 3B, the case where the valid area image has a circular shape capable of including seven symbols at the maximum has been described. In the invention, however, the valid area image does not necessarily have a shape physically surrounding symbols as shown in FIGS. 1A, 1B, FIGS. 2A, 2B and FIGS. 3A, 3B.

Namely, in the present invention, the valid area image is an image indicative of a valid area so that a symbol included in the valid area image corresponds to a symbol belonging to the valid area indicated by the valid area image. Therefore, in a case of changing the color of a symbol belonging to the valid area, an image of which color is changed is the valid area image. In a case of designating a symbol belonging to the valid area by using a predetermined image (such as an image indicative of an arrow), the predetermined image is the valid area image. In a case where the valid area image includes a plurality of symbols, the symbols are neighboring to one another.

In the examples shown in FIGS. 1A, 1B, FIGS. 2A, 2B and FIGS. 3A, 3B, the case of displaying one or the plurality of the valid area images in such a manner the valid area images move has been described. In the present invention, alternately, the moving symbol arrangement image may be displayed. In the present invention, displaying one or the plurality of the valid area images in such a manner that the valid area images move corresponds to displaying one or the plurality of the valid area images moving relatively to the symbol arrangement image. Therefore, the following manners of displaying (I) to (III) are included in the manner of displaying that one or the plurality of the valid area images move, of the present invention.

(I) Displaying to the screen one or the plurality of the valid area images in such a manner that the valid area images move, with the symbol arrangement image fixed.

(II) Displaying to the screen the symbol arrangement image in such a manner that the symbol arrangement image moves, with the one or the plurality of the valid area images fixed.

(III) Displaying the valid area images and the symbol arrangement image in such a manner that both of one or the plurality of the valid area images and the symbol arrangement image move so that their relative positions change.

In the present embodiment, there has been described the case where, on condition that any one of the valid area images includes a predetermined number or more of symbols of an identical kind, a payout according to the symbol satisfying the condition and a predetermined number of coin-outs corresponding to the symbol. In the present invention, however, the condition for conducting a payout is not limited to this case. For example, a payout may be conducted according to a combination, arrangement, and the like of symbols in the valid area image.

In the example shown in FIG. 5, a case of calculating a payout based on the numbers A, B, and C of coin-outs for each of a symbol included in the non overlap area, a symbol included in the two-image overlap area, and a symbol included in the three-image overlap area has been described. In the present invention, a payout may be calculated based on the number B or C of coin-outs for a symbol of the identical kind as a symbol included in the overlap area. In a case of applying this configuration to the present embodiment, for example, as shown in FIG. 3B, when three "JEWELs" are included in the valid area image V1, one of them is included in the overlap area W4, and the number of coins inserted for the game is 50, a payout for the valid area image V1 is calculated as (3×90)×50=13500 (coins).

In the present embodiment, the case where the number of the valid area images is preliminarily determined in accordance with the number of BETs has been described. In the present invention, for example, one valid area image may be displayed irrespective of the number of BETs in such a manner as to move, and after the valid area image stops, the number of valid area images may increase in accordance with the number of BETs and become a predetermined number.

In the present embodiment, the case has been described in which, when two or more valid area images exist, the position at which each of the valid area images stops is determined individually and an overlap area is not always created. In the present embodiment, when two or more valid area images exist, the positions of the valid area images may be determined so that an overlap area is always created. Similarly, when three or more valid area images exist, a three-image overlap area may be always created.

In the present embodiment, a case has been described in which, when two or more valid area images exist, a payout is conducted only when the condition that a predetermined number of symbols of the identical kind are included in each of the valid area images is satisfied. In the present invention, a payout may be conducted when the total number of symbols included in the valid area images satisfies the condition.

In the present invention, without setting a condition for conducting a payout, a payout may be conducted according to symbols included in each of the valid area images and the predetermined number of coin-outs corresponding to each of the symbols. In a case of applying the configuration to the embodiment, when the number of coins inserted is 50 in the example shown in FIG. 2B, the valid area image V includes two "SUNs", one "MOON", two "STARs", and two "RIBBONs". Consequently, a payout is [(2×10)+(1×5)+(2×3)+(2×1)]×50=1650 (coins). In a case of employing the configuration, by disposing a symbol (for example, "BLANK") for which the number of coin-outs is zero in the symbol arrangement image, an expectation value can be adjusted.

In the present invention, when a predetermined number or more of symbols of an identical kind are included in any one of the valid area images, a payout may be conducted according to all the symbols in the valid area image and the predetermined number of coin-outs corresponding to each of the symbols.

Figure 6:
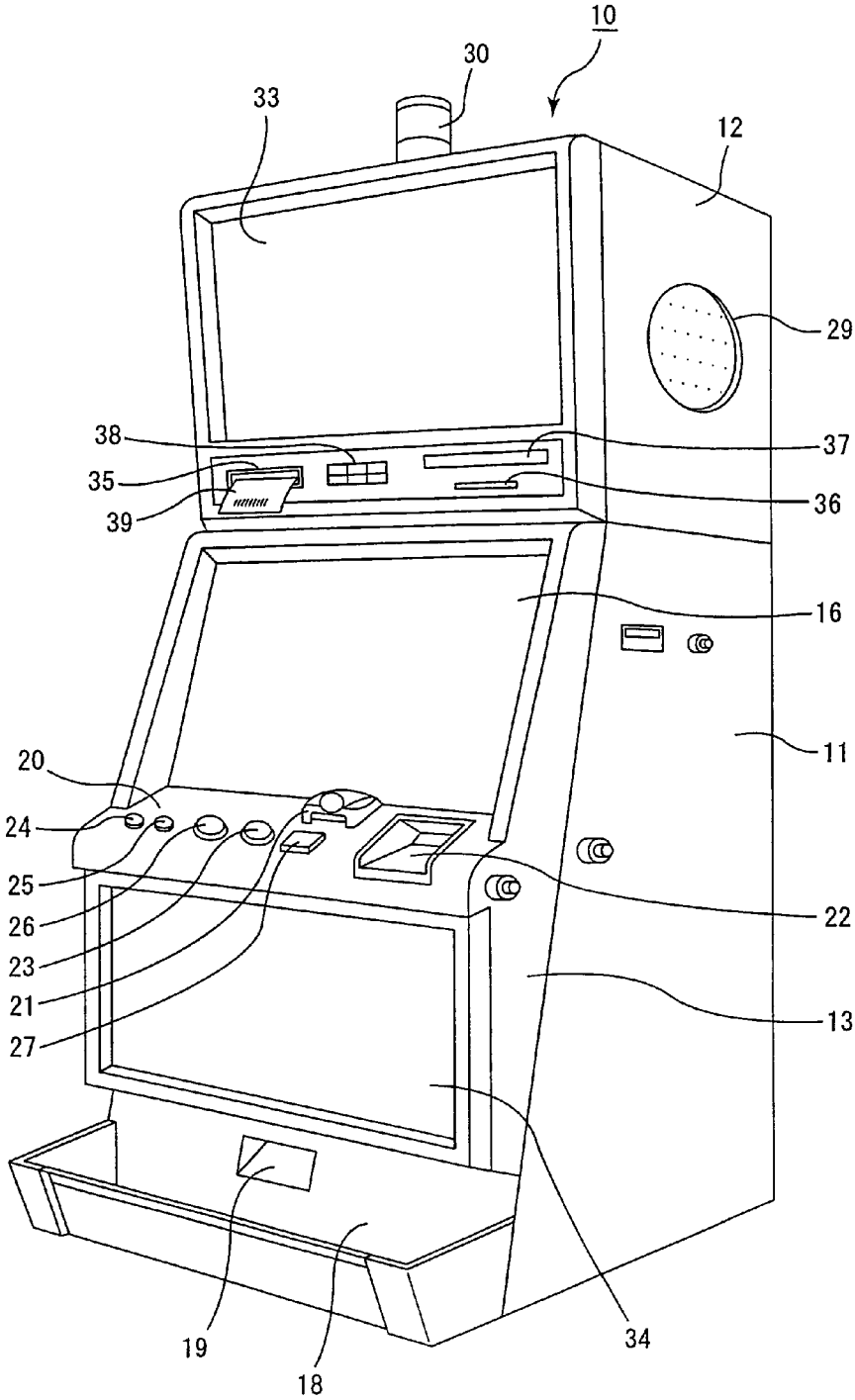
FIG. 6 is a perspective view schematically showing a slot machine according to an embodiment of the present invention.

FIG. 6 is a perspective view schematically showing the slot machine according to the present embodiment.

The slot machine 10 has a cabinet 11, a top box 12 mounted on the cabinet 11, and a main door 13 provided at the front face of the cabinet 11. A lower image display panel 16 is provided on the front side of the main door 13. The lower image display panel 16 has a liquid crystal panel and the symbol arrangement image A and the valid area image V (refer to FIGS. 1A 1B, FIGS. 2A, 2B and FIGS. 3A, 3B) are displayed thereto. The lower image display panel 16 corresponds to the display in the present invention. In the lower image display panel 16, a number-of-credits display section 31 and a number-of-payouts display section 32 (not shown) are set.

In the number-of-credits display section 31, the number of credited coins is displayed by an image. In the number-of-payouts display section 32, the number of coin-outs as a payout is displayed by an image.

Further, although not shown, a touch panel 69 is provided on the front face of the lower image display panel 16. A player can input various commands by operating the touch panel 69.

Below the lower image display panel 16, a control panel 20 including a plurality of buttons 23 to 27 by which a command related to a game progress is entered by a player, a coin receiving slot 21 for accepting a coin into the cabinet 11, and a bill validator 22 are provided.

The control panel 20 is provided with the start button 23, the change button 24, the CASHOUT button 25, the 1-BET button 26, and the maximum-BET button 27. The start button 23 is provided for entering a command to start a game. The change button 24 is used for asking a clerk in a game arcade to convert a bill to coins. The CASHOUT button 25 is used to enter a command to pay credited coins out to a coin tray 18.

The 1-BET button 26 is used to enter a command of betting one coin for a game from the credited coins. The maximum-BET button 27 is used to enter a command of betting the maximum number (in the present embodiment, 50) of coins which can be bet for one game from the credited coins.

The bill validator 22 is used to identify whether a bill is appropriate or not and accept a regular bill into the cabinet 11. The bill validator 22 may be configured to read a ticket 39 with a bar code which will be described later. On the front face of the lower part of the main door 13, that is, below the control panel 20, a belly glass 34 on which a character or the like of the slot machine 10 is drawn is provided.

An upper image display panel 33 is provided on the front face of the top box 12. The upper image display panel 33 has a liquid crystal panel and an image indicative of, for example, introduction of a game and explanation of rules of the game is displayed thereto.

The top box 12 is provided with a speaker 29. Below the upper image display panel 33, a ticket printer 35, a card reader 36, a data display 37, and a key pad 38 are provided. The ticket printer 35 prints a bar code encoding data such as the number of credits, date and time, and the identification number of the slot machine 10 onto a ticket, and outputs the printed ticket as the ticket 39 with the bar code. The player can make another slot machine read the ticket 39 with the bar code to play a game in the another slot machine and change the ticket 39 with the bar code to a bill or the like at a predetermined place in the game arcade (for example, a cashier in a casino).

The card reader 36 is used for reading data from a smart card and writing data onto a smart card. On the smart card, for example, data for identifying a player and data of the history of games having played by the player is stored. On the smart card, data corresponding to coins, bills, or credits may be stored. In place of the smart card, a magnetic stripe card may be employed. The data display 37 is comprised of a fluorescent display or the like for displaying, for example, data read by the card reader 36 and data entered by the player using the key pad 38. The key pad 38 is used to enter a command and data related to issue of a ticket or the like.

Figure 7:
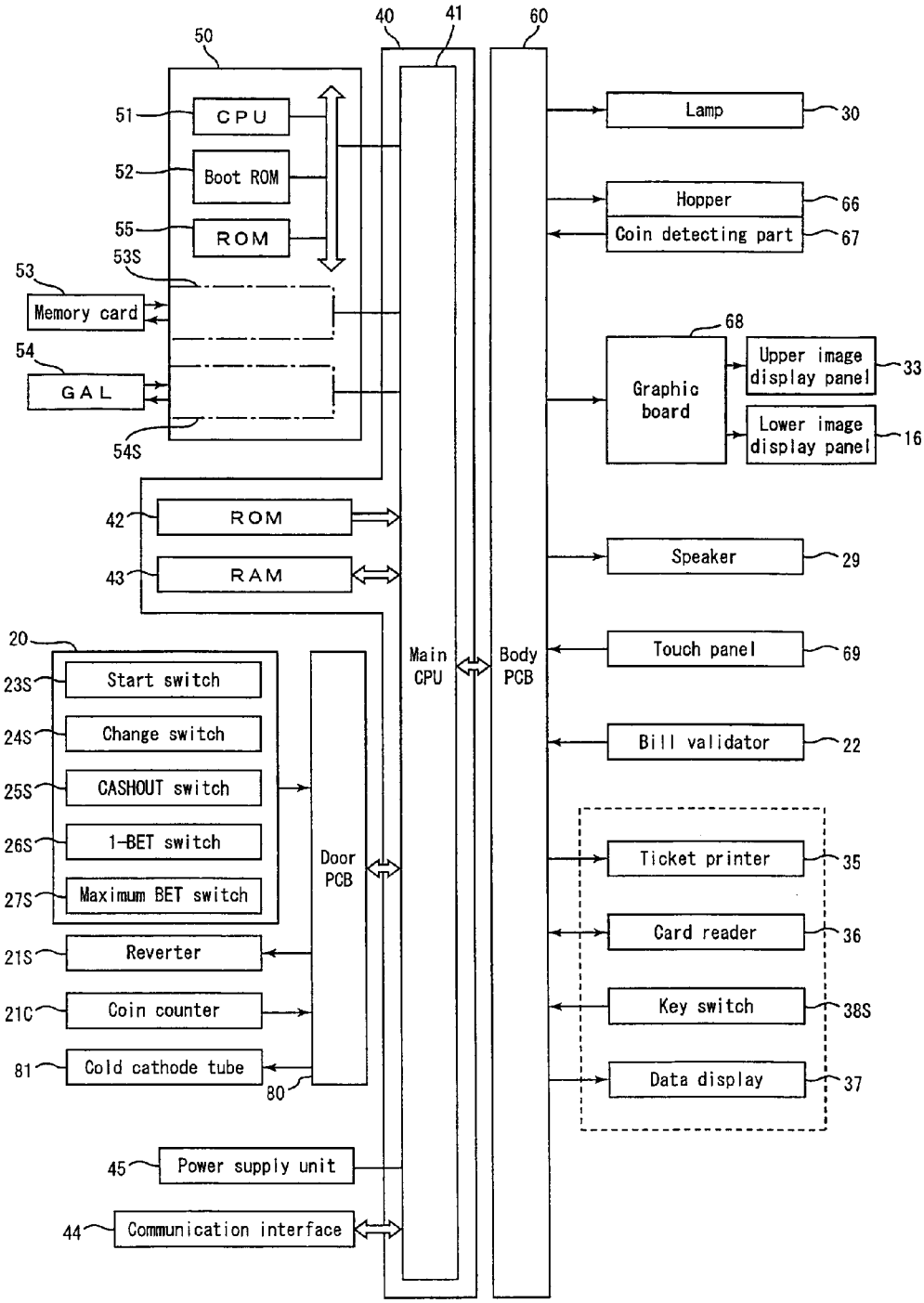
FIG. 7 is a block diagram showing the internal structure of the slot machine illustrated in FIG. 4.

FIG. 7 is a block diagram showing the internal configuration of the slot machine illustrated in FIG. 6.

A gaming board 50 has a CPU (Central Processing Unit) 51, a ROM 55, and a boot ROM 52 which are connected to each other via an internal bus, a card slot 53S corresponding to a memory card 53, and an IC socket 54S corresponding to a GAL (Generic Array Logic) 54.

The memory card 53 is constituted of non-volatile memories such as a COMPACTFLASH® and stores a game program and a game system program. The game program includes a symbol selecting program. The symbol selecting program is a program for determining symbols rearranged in the symbol arrangement image. The symbol selection program includes symbol weighing data associated with respective plurality of types of payout ratios (for example, 80%, 84%, 88%). The symbol weighting data is data which designates the correspondent relationships between respective symbols and one or more random numbers which fall within a predetermined numerical range (0 to 255). The payout ratio is determined based on payout-ratio setting data output from the GAL 54. Based on the symbol weighing data corresponding to the payout ratio, symbols rearranged in the symbol arrangement image are determined. The game program also includes table data (see FIG. 3) indicative of the correspondent relationships between symbols and the numbers of coin-outs. Further, the game program includes table data indicative of the correspondent relationship between each symbol and the number of coin-outs (see FIG. 4) and table data indicative of the correspondent relationship between the number of BETs and the number of the valid area images (see FIG. 5).

The card slot 53S is configured so that the memory card 53 can be inserted therein or drawn out therefrom, and is connected to a mother board 40 via an IDE bus. Therefore, by removing the memory card 53 from the card slot 53S, making another game program and another game system program written on the memory card 53, and inserting the memory card into the card slot 53S, the kind or the content of a game played in the slot machine 10 can be changed. The game program includes a program related to a game progress. The game program includes image data and sound data output during play. The image data includes image data of the symbol arrangement image and image data of the valid area image.

The GAL 54 is a type of PLD having a fixed OR array structure. The GAL 54 includes a plurality of input ports and a plurality of output ports and, when predetermined data is input to an input port, the GAL 54 outputs data corresponding to the aforementioned data from an output port. The data output from this output port is the aforementioned payout-ratio setting data.

Further, the IC socket 54S is configured to allow the GAL 54 to be attached thereto and detached therefrom and is connected to the motherboard 40 through a PCI bus. Accordingly, the GAL 54 can be replaced with another GAL 54 to change the payout-ratio setting data.

The CPU 51, the ROM 55, and the boot ROM 52 connected to each other via the internal bus are connected to the mother board 40 via the PCI bus.

The mother board 40 is constructed with a general-purpose mother board commercially available (a printed circuit board on which basic parts of a personal computer are mounted) and includes: a main CPU 41; ROM (Read Only Memory) 42; RAM (Random Access Memory) 43 and a communication interface 44. The mother board 40 corresponds to a controller.

The ROM 42 is constituted of a memory device such as a flash memory and stores thereon a program such as BIOS (Basic Input/Output System) executed by the main CPU 41 and permanent data. When the BIOS is executed by the main CPU 41, not only is initialization processing for predetermined peripheral devices conducted, but capture processing for the game program and game system program stored on the memory card 53 is also started via the gaming board 50. In the invention, the ROM 42 may be a rewritable memory or not rewritable.

RAM 43 stores data and a program used at the time of operation of the main CPU 41. The RAM 43 can also store a game program. Further, the RAM 43 stores data on the number of credits, the number of coins inserted for a game, and the number of coin-outs.

Both a body PCB (Printed Circuit Board) 60 and a door PCB 80 which will be described later are connected to the mother board 40 by USB. A power supply unit 45 is also connected to the mother board 40.

Equipment and devices for generating an input signal to be entered to the main CPU 41 and equipment and devices of which operations are controlled by a control signal output from the main CPU 41 are connected to the body PCB 60 and the door PCB 80. The main CPU 41 executes the game program stored in the RAM 43 based on an input signal entered to the main CPU 41, and thereby performs predetermined computational processing, stores the result in the RAM 43, and transmits a control signal to the equipment and devices as control processing for each of the equipment and devices.

To the main-body PCB 60, a lamp 30, a hopper 66, a coin detecting part 67, a graphic board 68, the speaker 29, the touch panel 69, the bill validator 22, the ticket printer 35, the card reader 36, a key switch 38S and the data display 37 are connected. The lamp 30 lights up in a predetermined pattern based on a control signal output from the main CPU 41.

The hopper 66 is installed in the cabinet 11 and, based on the control signal output from the main CPU 41, pays out a predetermined number of coins from a coin payout exit 19 onto the coin tray 18. The coin detecting section 67 is installed inside the coin payout exit 19 and when detecting that a predetermined number of coins has been paid out from the coin payout exit 19, the coin detecting section 67 outputs an input signal to the main CPU 41.

The graphic board 68 controls image display on the upper image display panel 33 and the lower image display panel 16 based on the control signal output from the main CPU 41. In the number-of-credits display section 31 (not shown) on the lower image display panel 16, the number of credits stored in the RAM 43 is displayed. In the number-of-payouts display section 32 (not shown) on the lower image display panel 16, the number of coin-outs is displayed. The graphic board 68 includes a VDP (Video Display Processor) for generating image data based on a control signal output from the main CPU 41 and a video RAM for temporarily storing the image data generated by the VDP, and of the like equipments. It should be noted that the image data used in generating image data by the VDP is included in the game program read from the memory card 53 and stored in the RAM 43.

The bill validator 22 identifies whether a bill is appropriate or not and accepts a regular bill into the cabinet 11. When a regular bill is accepted, the bill validator 22 outputs an input signal to the main CPU 41 based on the face amount of the bill. The main CPU 41 stores the number of credits according to the amount of the bill transmitted by the input signal into the RAM 43.

Based on the control signal output from the main CPU 41, the ticket printer 35 prints a bar code obtained by encoding data such as the number of credits, date and time, and the identification number of the slot machine 10 stored in the RAM 43 onto a ticket, and outputs the printed ticket as the ticket 39 with the bar code. The card reader 36 reads data from a smart card, transmits the data to the main CPU 41 and writes data to a smart card based on the control signal from the main CPU 41. The key pad 38 is provided with the key switch 38S and when the key pad 38 is operated by the player, a predetermined input signal is output to the main CPU 41. Based on a control signal output from the main CPU 41, the data display 37 displays data read by the card reader 36 or data input by a player via the key pad 38.

To the door PCB 80, the control panel 20, a reverter 21S, a coin counter 21C, and a cold cathode tube 81 are connected. The control panel 20 is provided with a start switch 23S corresponding to the start button 23, a change switch 24S corresponding to the change button 24, a CASHOUT switch 25S corresponding to the CASHOUT button 25, a 1-BET switch 26S corresponding to the 1-BET button 26, and a maximum BET switch 27S corresponding to the maximum BET button 27. Each of the switches 23S to 27S outputs an input signal to the main CPU 41 when the corresponding button in the buttons 23 to 27 is operated by a player.

The coin counter 21C is installed inside the coin insertion port 21, and determines whether a coin inserted in the coin receiving slot 21 by the player is regular or not. Coins other than true ones are ejected from the coin payout exit 19. The coin counter 21C outputs an input signal to the main CPU 41 when a regular coin is detected.

The reverter 21S operates based on the control signal output from the main CPU 41 and properly distributes a coin recognized as a regular coin by the coin counter 21C to a cash box (not shown) or the hopper 66, which are disposed in the slot machine 10. That is, when the hopper 66 is filled with coins, regular coins are distributed to the cash box by the reverter 21S. On the other hand, in a case where the hopper 66 is not filled with coins, regular coins are distributed to the hopper 66. The cold cathode tube 81 functions as a backlight mounted on the rear side between the lower image display panel 16 and the upper image display panel 33 and lights up based on a control signal output from the main CPU 41.

Next, processing performed in the slot machine 10 will be described. The main CPU 41 reads and executes the game program to progress a game.

Figure 8:
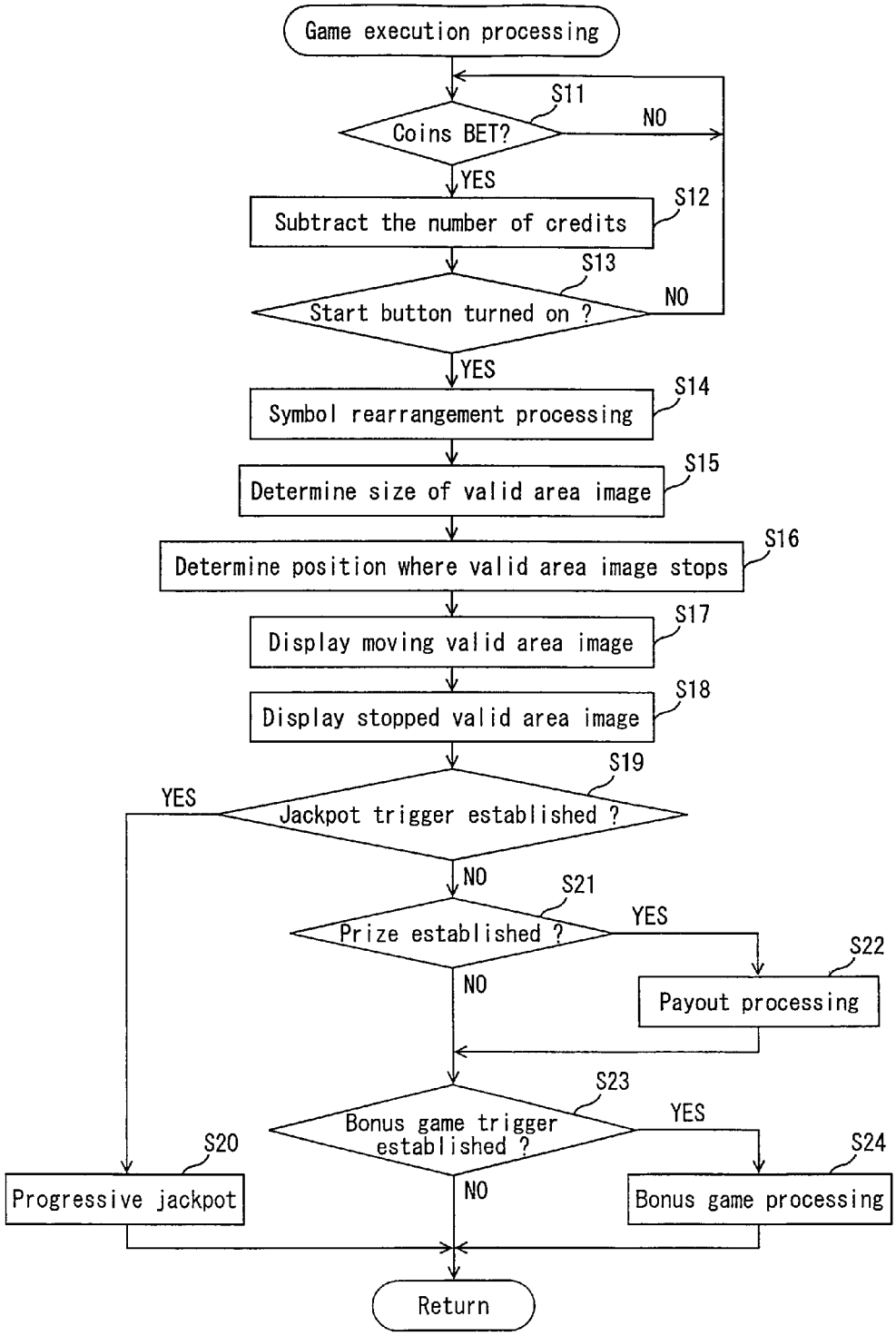
FIG. 8 is a flowchart showing a subroutine of game execution processing.

FIG. 8 is a flowchart showing a subroutine of the game execution processing.

In the game execution processing, firstly, the main CPU 41 determines whether a coin is BET or not (step S11). In the processing, the main CPU 41 determines whether or not an input signal output from the 1-BET switch 26S has been received when the 1-BET button 26 is operated, or an input signal output from the maximum-BET switch 27S received when the maximum-BET button 27 is operated. When it is determined that no coin is BET, the processing returns to step S11.

On the other hand, in a case where it is determined in step S11 that a coin is BET, the main CPU 41 performs processing of subtracting the number of credits stored in the RAM 43 in accordance with the number of coins BET (step S12). In a case where the number of coins BET is larger than the number of credits stored in the RAM 43, without performing the processing of subtracting the number of credits stored in the RAM 43, the processing returns to step S11. In a case where the number of coins BET exceeds the upper limit value (50 in the present embodiment) of coins which can be BET for one game, without performing the processing of subtracting the number of credits stored inn the RAM 43, the processing advances to step S12. A part (for example, a predetermined ratio) of the subtracted number of credits is cumulatively accumulated in the RAM 43 as an accumulated value for a progressive jackpot.

After that, the main CPU 41 determines whether the start button 23 has been turned on or not (step S13). In this processing, the main CPU 41 determines whether an input signal output from the start switch 23S when the start button 23 is pressed has been received or not.

In a case where the main CPU 41 determines that the start button 23 is not turned on, the routine returns to step S11.

In a case where the start button 23 is not turned on (for example, an instruction of finishing the game has been input without turning on the switching button 23), the main CPU 41 cancels the result of subtraction in step S12.

On the other hand, in a case where it is determined in step S13 that the start button 23 is turned on, the main CPU 41 rearranges the symbols S in the lower image display panel 16 (step S14). In the processing, the main CPU 41 executes the symbol selecting program and determines the kinds of symbols S disposed in the symbol arrangement image A. At this time, one symbol arrangement image A may be generated by independently determining the plurality of symbols S arranged in the symbol arrangement image A one by one. Alternately, a plurality of kinds of symbol arrangement images A having different patterns of symbols S are prepared and one of the images may be selected in step S14. Next, the symbol arrangement image A in which the determined symbols S are arranged is displayed to the lower image display panel 16. As a result, the symbols S are rearranged in the lower image display panel 16.

After the processing of step S14, the main CPU 41 determines the number of the valid area images V (step S15). As described above, the number of valid area images V is determined based on the number of BETs (see FIG. 5).

Next, the position at which each of the valid area images V stops is determined (step S16). In a case of executing the processing, for example, a table in which data indicative of the position of each of symbols S in the symbol arrangement image A and one or plural random numbers belonging to a predetermined numerical range are associated with each other is pre-stored in the RAM 43. In step S16, a program of extracting one random number from the predetermined numerical range is developed on the RAM 43 and executed to determine the position at which each of the valid area images V stops, based on the obtained random number and the table data.

Subsequently, one or a plurality of the valid area images V are displayed to the lower image display panel 16 so as to be superposed on the symbol arrangement image A in such a manner that the valid area images V move along a predetermined path (step S17). With respect to the path, speed, and a period of the valid area images V moving, for example, one of a plurality of predetermined patterns may be selected, or may be determined by performing a calculation based on the result of the processing of step S16. Next, the valid area images V are stop-displayed in the position determined in the processing of step S16 (step S18). Consequently, seven symbols are included in each of the stopped valid area images V.

Next, the main CPU 41 determines whether the jackpot trigger is established or not, that is, whether one or more "SMILEs" are included in any one of the stopped valid area images V or not (step S19). In a case where it is determined that the jackpot trigger is established, the main CPU 41 performs the progressive jackpot (step S20). The number of coins to be paid out for the progressive jackpot corresponds to a value obtained by adding the initial payout value to an accumulated value stored in the RAM 43 (an accumulated value of a part of the number of game media inserted). The coins are paid out by hand. The processing executed by the main CPU 41 in step S20 is, for example, output of notification sound from the speakers 29, lighting of the lamp 30, printing of a ticket 39 on which a bar code indicative of the number of coins to be paid out is printed, and the like. After that, the subroutine is finished.

On the other hand, when it is determined in step S19 that the jackpot trigger is not established, the main CPU 41 determines whether a prize is established or not (step S21). In the present embodiment, the state where a prize is established denotes a state where three or more symbols S of at least one kind of "JEWEL", "SUN", "MOON", "STAR", "HEART", and "RIBBON" are included in any one of the valid area image V (see FIG. 3).

When a prize is established, the main CPU 41 pays out coins according to the symbol included in the valid area image V and the predetermined number of coin-outs corresponding to the symbol (step S22). In a case of accumulating coins, the main CPU 41 performs processing of adding the number of credits stored in the RAM 43. On the other hand, in a case of paying out the coins, the main CPU 41 transmits a control signal to the hopper 66 to pay out the predetermined number of coins.

In a case where it is determined in step S21 that a prize is not established or in a case where the processing of step S22 has been executed, the main CPU 41 determines whether a bonus game trigger is established or not, that is, whether three or more "CROWNs" are included in any one of the valid area image V or not (step S23). When it is determined that the bonus game trigger is established, the main CPU 41 reads a program for performing a predetermined number of free games as a bonus game from the RAM 43 and executes bonus game processing (step S24). In a case where it is determined that the bonus game trigger is not established in step S23 or in a case where the processing of step S24 is executed, the main CPU 41 finishes the subroutine.

As described above, the slot machine 10 of the present embodiment includes: the lower image display panel 16 having the screen capable of displaying the symbol arrangement image A in which a plurality of symbols S are arranged and the valid area images V having the circular shape capable of including symbols in number in accordance with the number of BETs; and the main CPU 41 displaying to the screen the symbol arrangement image A and one or the plurality of the valid area image V so as to superpose the valid area images V on the symbol arrangement image A, in such a manner that the valid area images V move and then stop (see FIGS. 1A, 1B, FIGS. 2A, 2Ba and FIGS. 3A, 3B), and conducting a payout according to the symbols included in each of the stopped valid area images V (see FIG. 4). The main CPU 41 conducts a payout in a case where a predetermined number or more of symbols of an identical kind are included in each of the valid area images V (see FIG. 4). Further, the main CPU 41 conducts a payout in accordance with the symbols included in the valid area image V and the predetermined number of coin-outs corresponding to the symbols (see FIG. 4). A payout in accordance with a symbol included in the overlap area W in which a plurality of valid area images V overlap with each other is higher than that in a case of the symbol included in the valid area image other than the overlap area.

Although the embodiment according to the present invention has been described above, the description presents only some of the specific examples, and does not particularly limit the present invention, and specific constitutions of each means and the like can be properly changed in terms of design. Further, the effects described in the embodiment of the present invention are only examples of the most preferable effects generated from the present invention and the effect to be caused by the present invention is not limited to those described in the embodiment of the present invention.

In the above detailed description, for a better and easier understanding of the present invention, the description is mainly made on the featuring aspects of the present invention. The present invention is not limited to the embodiments in the above detailed description, and may be applied to other varieties of embodiments. Also, it is to be understood that the phraseology and terminology employed in this specification are used to precisely describe the present invention, and should not be regarded as limiting the interpretation of the present invention. Moreover, based on the conception described in the present specification, those skilled in the art will readily come up with other configuration, systems and methods and the like included in the conception of the present invention. As such, it should be elucidated that the claims include such equivalent constitutions insofar as they do not depart from the spirit and scope of the present invention. Further, the purpose of the foregoing abstract is to enable the U.S. Patent and Trademark Office and general public institutions, and those skilled in the art and the like who are not familiar with patent or legal terminology, to quickly determine the nature and essence of the technical disclosure of this application with a simple search. Therefore, the abstract is not intended to define the scope of the present invention, which should be measured by the description of the claims. Furthermore, for fully understanding the purposes and the featuring effects of the present invention, desirably, the present invention is interpreted with reference to published publications and the like.

The detailed descriptions aforementioned may be presented in terms of processing executed by a computer. Those descriptions and terms set forth in the above are described for the purpose that those skilled in the art understand the present invention in a most effective way. In the present specification, each step used for leading one result should be understood a self-consistent procedure. In each step, sending and receiving, or recording or the like of electrical or magnetic signals are performed. Although, such signals are expressed in bit, value, symbol, character, term, number and the like in processing of each step; however, it is important to note that those expressions are used simply for convenience of explanation. Moreover, processing in each step is in some cases described using expressions in common with those for human activities, but processing described in the present specification is in principle performed by various apparatuses. Furthermore, some other constitutions required for carrying out the respective step are considered to be self-explanatory from the aforementioned descriptions.

What is claimed as new and desired to be secured by Letters Patent of the United States is:

1. A slot machine comprising:

a display having a screen capable of displaying a symbol arrangement image in which a plurality of symbols are arranged and a plurality of valid area images each having a shape capable of including one or more of said symbols; and a controller in communication with the display, said controller determining the number of said valid area images in accordance with the number of BETs, displaying to said screen said symbol arrangement image and the determined number of said valid area images so as to superpose said valid area images on said symbol arrangement image, in such a manner that said valid area images move and then stop, and providing an award in accordance with a symbol included in each of said stopped valid area images so that an award in accordance with a symbol included in an overlap area where the valid area images overlap with each other is higher than an award provided in a case of the symbol included in said valid area image other than said overlap area.

2. The slot machine according to claim 1, wherein said controller provides said award in a case where a predetermined number or more of symbols of an identical kind are included in any one of said valid area images.

3. The slot machine according to claim 1, wherein said controller provides said award in accordance with the symbol included in said valid area image and a predetermined number of game media to be paid out corresponding to said symbol.

4. A slot machine comprising:

a display having a screen capable of displaying a symbol arrangement image in which a plurality of symbols are arranged and a plurality of valid area images each having a shape capable of including one or more of said symbols; and a controller in communication with the display, said controller determining the number of said valid area images in accordance with the number of BETs, displaying to said screen said symbol arrangement image and the determined number of said valid area images so as to superpose said valid area images on said symbol arrangement image, in such a manner that said valid area images move and then stop, and providing, in a case where a predetermined number or more of symbols of an identical kind are included in any one of said stopped valid area images, an award in accordance with the symbol included in said stopped valid area image so that an award in accordance with a symbol included in an overlap area where said valid area images overlap with each other is higher than an award provided in a case of the symbol included in said valid area image other than said overlap area.

5. The slot machine according to claim 4, wherein said controller provides said award in accordance with the symbol included in said valid area image and a predetermined number of game media to be paid out corresponding to the symbol.

6. A slot machine comprising:

a display having a screen capable of displaying a symbol arrangement image in which a plurality of symbols are arranged and a plurality of valid area images each having a shape capable of including one or more of said symbols; and a controller in communication with the display, said controller determining the number of said valid area images in accordance with the number of BETs, displaying to said screen said symbol arrangement image and the determined number of said valid area images so as to superpose said valid area images on said symbol arrangement image, in such a manner that said valid area images move and then stop, and providing, in a case where a predetermined number or more of symbols of an identical kind are included in any one of said stopped valid area images, an award in accordance with the symbol included in said stopped valid area image and a predetermined number of gaming media to be paid out corresponding to the symbol so that an award in accordance with a symbol included in an overlap area where said valid area images overlap with each other is higher than an award provided in a case of the symbol included in said valid area image other than said overlap area.

7. A playing method of a slot machine, performed by a controller connected to a display, comprising the steps of:

determining via the controller the number of valid area images each having a shape capable of including one or more symbols in accordance with the number of BETs;

displaying to a screen of said display a symbol arrangement image in which a plurality of symbols are arranged and the determined number of said valid area images so as to superpose said valid area images on said symbol arrangement image, in such a manner that said valid area images move and then stop; and providing an award as determined by the controller in accordance with a symbol included in each of said stopped valid area images so that an award in accordance with a symbol included in an overlap area where said valid area images overlap with each other is higher than an award provided in a case of the symbol included in said valid area image other than said overlap area.

8. The playing method of the slot machine according to claim 7, further comprising the step of providing said award in a case where a predetermined number or more of symbols of an identical kind are included in any one of said stopped valid area images.

9. The playing method of the slot machine according to claim 7, further comprising the step of providing said award in accordance with the symbol included in said valid area image and a predetermined number of game media to be paid out corresponding to said symbol.

10. A playing method of a slot machine, performed by a controller connected to a display, comprising the steps of:

determining via the controller the number of valid area images each having a shape capable of including one or more symbols in accordance with the number of BETs;

displaying to a screen of said display a symbol arrangement image in which a plurality of symbols are arranged and the determined number of said valid area images so as to superpose said valid area images on said symbol arrangement image, in such a manner that said valid area images move and then stops; and providing, in a case where a predetermined number or more of symbols of an identical kind are included in any one of said stopped valid area images, an award as determined by the controller in accordance with the symbol included in said stopped valid area image so that an award in accordance with a symbol included in an overlap area where said valid area images overlap with each other is higher than an award provided in a case of the symbol included in said valid area image other than said overlap area.

11. The playing method of the slot machine according to claim 10, further comprising the step of providing said award in accordance with the symbol included in said valid area image and a predetermined number of game media to be paid out corresponding to the symbol.

12. A playing method of a slot machine, performed by a controller connected to a display, comprising the steps of:

determining via the controller the number of valid area images each having a shape capable of including one or more symbols in accordance with the number of BETs;

displaying to a screen of said display a symbol arrangement image in which a plurality of symbols are arranged and the determined number of said valid area images so as to superpose said valid area images on said symbol arrangement image, in such a manner that said valid area images move and then stop; and providing, in a case where a predetermined number or more of symbols of an identical kind are included in any one of said stopped valid area images, an award as determined by the controller in accordance with the symbol included in said stopped valid area image and the predetermined number of game media to be paid out corresponding to said symbol so that an award in accordance with a symbol included in an overlap area where said valid area images overlap with each other is higher than an award provided in a case of the symbol is included said valid area image other than said overlap area.

* * * * *